US006003761A

United States Patent [19]

Chapman

[11] Patent Number: 6,003,761

[45] Date of Patent: Dec. 21, 1999

[54] DRIVE-UP MAIL DISTRIBUTION, STORAGE AND PICK-UP ASSEMBLY

[76] Inventor: Glen E. Chapman, 935 Mulberry Dr., San Marcos, Calif. 92069

[21] Appl. No.: 08/784,361

[22] Filed: Jan. 17, 1997

[51] Int. Cl.[6] ..... B65D 91/00

[52] U.S. Cl. ..... 232/24; 232/27

[58] Field of Search ..... 312/216; 232/24, 232/27, 25, 26, 34, 39, 19, 20, 21; 248/131, 417

[56] References Cited

U.S. PATENT DOCUMENTS

| | | | |
|---|---|---|---|
| 481,621 | 8/1892 | Light | 232/24 |
| 618,846 | 2/1899 | Crowder | 232/25 |
| 693,770 | 2/1902 | Wright et al. | 232/24 |
| 725,080 | 4/1903 | Henry | 232/27 |
| 1,459,031 | 6/1923 | Murphy | 232/25 |
| 1,817,191 | 8/1931 | Harmony | 232/25 X |
| 2,025,251 | 12/1935 | Steinbronn | 232/34 |
| 2,841,327 | 7/1958 | Chasworth | 232/25 X |
| 3,367,613 | 2/1968 | Christensen | 248/417 X |
| 4,161,274 | 7/1979 | Bishop et al. | 232/25 X |
| 4,753,385 | 6/1988 | Phipps et al. | 232/30 X |
| 5,445,086 | 8/1995 | Bolduc | 232/39 |

*Primary Examiner*—Blair M. Johnson
*Attorney, Agent, or Firm*—John J. Murphey

[57] ABSTRACT

A drive-up mail distribution, storage and pick-up assembly comprising a plurality of mail boxes, the boxes arranged in horizontal rows and vertical columns and retained in the assembly in an outer frame, each box defined by a central storage container bound at opposite ends by a lockable front door and rear access opening, the front doors of the boxes facing outward at heights above ground accessible from the window adjacent the driver of the vehicle.

22 Claims, 6 Drawing Sheets

DRIVE-UP MAIL DISTRIBUTION, STORAGE AND PICK-UP ASSEMBLY

BACKGROUND OF THE INVENTION

1. Field of the Invention

This invention pertains to the field of mail boxes. More particularly, the invention pertains to multiples of mail boxes arranged in a unique assembly and located in parking lots and other areas accessible by motor vehicle, wherein mail may be distributed to the boxes by postal or other employees, held therein for storage for eventual transfer to members of the public, and picked up by members of the public from inside their motor vehicle without having to exit the vehicle.

2. Description of the Prior Art

The day of the postman bringing mail to the occupant in a residence is swiftly coming to an end. To reduce costs and increase efficiency of postal transfer, postal authorities are moving toward distribution of mail to locations where many mail boxes are housed in a single structure to be stored therein awaiting pick-up by the public at their leisure, such as when going to work or coming home from work. In effect, the postal authorities have shifted the time used to transmit the mail from a centralized postal outlet to the addressee of the mail from the postal organization to the public. Where the resident or business person was used to merely walking outside their residence to their mailbox, located at or near the front door or front yard or parking lot, to get their mail, they now must walk or drive to an centralized post box facility to pick up their mail.

When a person goes to a post office to pick up their mail they open a mail box that is directly and fully accessible by a postal or other employee working directly behind the boxes. This requires the postal or other employee to be utilized in a direct relationship with the mail box renter and raises the cost of mail delivery. When using a drive-through mail pick-up system, there always needs to be a person working behind the window that, again, reduces efficiency and raises the price of postal delivery.

Present day post boxes may be located in a neighborhood, in structures where multiples of mail boxes are grouped for access by many neighbors, or may be located in post offices where other postal matters may be transacted, such as for using certified mail procedures and mailing packages by express mail, etc.

In each of these situations, not only is a large amount of time wasted by the public, but physically challenged persons, such as wheelchair-bound persons, are made to suffer because the trip undertaken by them to get their mail is unusually substantial in distance and extremely costly in time.

For instance, assuming approximately 250 trips to a rental mail box per year, the non-physically challenged user can access their rented postal box only by driving to the postal distribution office, parking their car in a crowded parking lot, walking to the building housing the box, accessing the postal box, and then returning to their car, and driving out of the parking lot. With an average of 10 to 12 minutes for this operation, on a good day, they spend upwards of 50 hours per year to accomplish this seemingly trifling task. When doubled or tripled the time for the wheelchair-bound person to perform the same operation, one can readily see that 150 hours per year becomes an odious task.

As matters stand, the parking spaces at postal offices and other rental distribution buildings, such as Mail Boxes U.S.A.®, are not used efficiently, and the postal authorities and franchisees are loath to purchase more land for expansion of their parking facilities. The hustle and bustle of driving to a post office parking lot, parking, walking to the post office box and retracing one's steps after obtaining the mail, has led to the aggravation of many persons and has done nothing to enhance the image of the postal system.

There has not been any recognition given to the fact that physically challenged persons have now conquered the transportation gap by being able to operate many motor vehicles with control devices especially designed for them. A great majority of wheel-chair-bound persons, young and old, are now able to drive cars about the streets and roads in the United States and have access to shopping, jobs, doctor visits, and vacations on their own without requiring the aid of others.

However, there has not been any development in the area of postal distribution, storage or pick-up by these persons other than to require them to park their vehicle in crowded parking lots with the related hazards contained therein, struggle out of their car and drive their wheel-chair across the lot and into the postal building, only to retrace their path after obtaining their mail. Satisfaction of the need to merge the benefits of motor vehicle operation with some sort of development in postal distribution will allow both normal and physically challenged persons to obtain their mail quicker than with the present system, without causing any delay or loss of efficiency on the part of the postal authorities.

SUMMARY OF THE INVENTION

This invention is a unique concept in distributing, storing and picking-up mail by unchallenged and physically challenged persons where the time element presently encountered by unchallenged persons is reduced over 80% and the time element encountered by physically challenged persons is reduced over 95%. The invention is to group mail boxes in a special way and locate them in areas where vehicles are invited, such as in parking lots, and arranging the boxes to be accessed from inside the window on the driver's side of the vehicle. These uniquely arranged postal boxes are assembled in rows and columns and are rentable by the public.

Another unique aspect of this invention is that the specific postal box is rented to the lessee in a location that is easily accessible from their specific vehicle. For instance, a lessee driving a low-slung sports-type car would be rented a box in a row or rows that are low to the ground so that they can merely reach out of the window on the driver's side of the vehicle and unlock the postal box door, reach in and grab the mail, extract it and lock the box and drive away. The operator of a sedan-type vehicle would be rented a postal box from a row or rows higher up in the stack of boxes while the operator of a truck would be rented a box from even higher rows.

In another embodiment of this invention, one assembly of mail boxes may be supported above another assembly of similar mail boxes and motorized means used to raise and/or lower the assemblies to a height that makes a specific mail box accessible to a person in a certain size vehicle. In this case, the assembly of mail boxes may be made in tiers where one assembly is mounted on a pole or support above another assembly. A pit may need to be excavated below the two assemblies and the mounting pole motorized to provide for the tiered assemblies to be raised, so that a box renter may seek to pick up their mail from a particular lower row and later lowered so that the bottom assembly enters the pit and allows the box renter to extract mail from their box which may be located in a higher tier.

A box containing a slot in the front door may optionally be provided for access by everyone renting a box in order to drop outgoing mail. A somewhat larger box may optionally be provided for receipt, storage and pick-up of parcels larger than one's postal box and is accessed by the renter of the box by having the key to that larger box left in the renter's postal box. Upon receipt of that key, the renter reads the key tag directing him or her to unlock and open the larger indicated parcel box and pick-up their parcel, then put the key in the outgoing mail drop slot.

The design of the assembled boxes allows for opening the assembly by a postal or other employee with a special key to provide access to the boxes for distribution of mail into the boxes. Once locked up with a charge of new mail, the boxes are ready to be accessed by the renters. A flag with a special mounting is optionally provided for raising by the postal or other employee, after loading the new mail in the boxes, so that renters are made aware when to check their boxes for new mail.

In another embodiment of this invention, a mail delivery flag may be attached to the outside of each individual mail box such as about the access key way, and be moved by the postal or other mail delivery employee from a downward position, indicating no mail in the box, to an upward position indicating mail in the box. In this manner, a box renter may drive past the assembly and not stop for mail until he or she can observe the mail delivery flag in the upward position.

The basic assembly of this invention is a plurality of mail boxes where the access doors are located in one plane on one side of the assembly and the access ports are covered over by an unlockable door for use when loading. Another assembly is contemplated where two assemblies are grouped together in a single unit, each assembly arranged with their doors facing away from each other to provide two planes of access to the unit. When located in areas where the unit can be accessed from both sides, the unit provides simultaneous access by renters using two vehicles on opposite sides of the assemblies so that more renters are serviced without significantly increasing the space required about the unit.

In another embodiment, a gravity-operated means is provided to allow rotation of the assembly 180° so that one renter may access either side of the unit without having to drive around to the other side thereof. In this embodiment, cam means are used to insure the unit always ends up with the plane of the mail box doors parallel to the driveway for the vehicles to pass when the operators pick up their mail.

In still another embodiment, a removable mail tray is conveniently located on the bottom or floor of each mail box, accessible through the front of the box, so that a renter of a box may pull it outward or remove it completely and hold it to look to see if he or she has removed all of the mail available for pick-up at that time and that no mail remains in the box.

Another novel aspect of this invention is that these assemblies and units may be assigned their own street address. The laws of various states, towns and villages are amenable to assigning such street addresses to each separate assembly or unit. This has the dual advantage of placing a person's postal box at an address dislocated from their residential address and allows small businesses to obtain and maintain an address separate and apart from the owner's residence. With the present amount of crime involving breaking into businesses, the maintenance of a postal box away from a residence means overall more security to the business.

When located in parking lots, the assembly or unit takes up no more than six (6) parking spaces in nose-to-nose arrangement. This is a small price to pay for drawing so many people, i.e., 30–360 renters, into the parking lot of a store or shopping mall. Studies have shown that drawing persons to a shopping mall, through third-party means, is an efficient method of increasing the traffic through the mall and thus serves as an impetus for bringing potential shoppers into the stores.

The invention is a drive-up mail distribution, storage and pick-up assembly comprising a plurality of mail boxes assembled in a frame, each box defined by a lockable front door and accessible to distribute mail therein, said boxes arranged in horizontal rows and vertical columns with their front doors lying in a common plane and facing outward at heights above ground accessible from the windows of the driver's door of vehicles all without the assistance of a live clerk or drive-through window.

Accordingly, the main object of this invention is an assembly of mail boxes that will reduce the time spent by all persons in retrieving their mail. Other objects of the invention include a means of allowing motor vehicle operators to obtain their mail without having to exit their vehicle, a means of reducing the time and aggravation of physically-challenged persons to obtain their mail, a means of making parking spaces at post offices far more efficient by allowing access to mail without leaving one's vehicle, a means of rendering physically-challenged persons "truly equal" to unchallenged persons with respect to picking up their mail, a means of reducing the time spent by many persons to obtain their mail from postal distribution centers, a means of merging the location of a vehicle driver on the front left side of a motor vehicle (for left side driven vehicles) or front right side of a motor vehicle (for right side driven vehicles) with a means to allow picking up of mail from a mail box arranged for that location on the vehicle, and a means of renting the location of a mail box commensurate with the height of the lessee's vehicle so that the driver need not exit his or her vehicle in order to obtain mail from their mail box.

These and other objects of the invention will become more apparent upon reading the following description of the preferred embodiment taken together with the drawings appended hereto. The scope of protection sought by the inventors may be gleaned from a fair reading of the claims that conclude this Specification.

DESCRIPTION OF THE PREFERRED EMBODIMENTS

Figure 1:
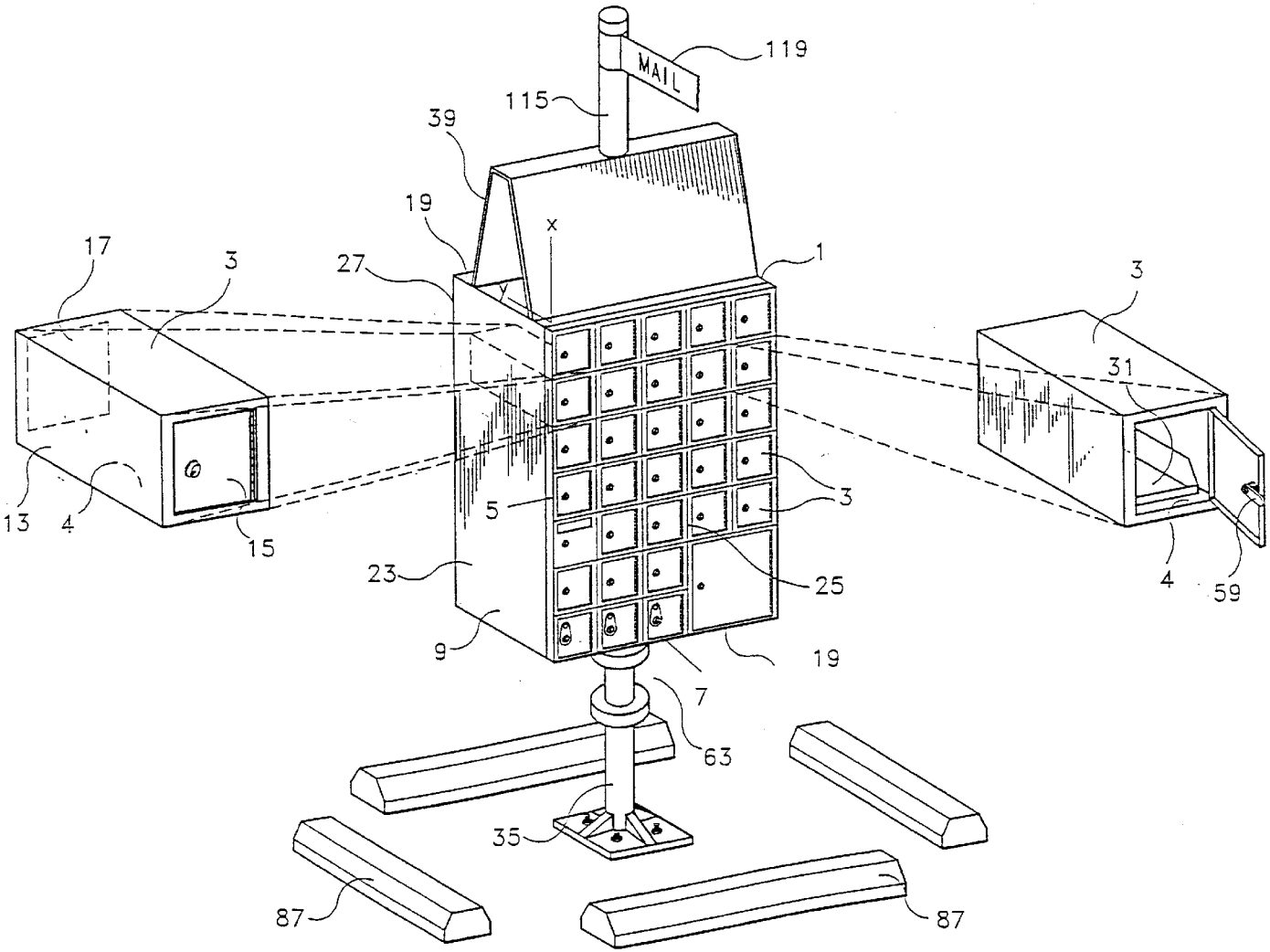
FIG. 1 is an illustrated view of the preferred embodiment of this invention showing one of the mail boxes in exploded view and another of the mail boxes supporting a mail tray.

Turning now to the drawings where like elements are identified with like numerals throughout the fifteen figures, FIG. 1 shows the general embodiment of this invention to be a drive-up mail distribution, storage and pick-up assembly 1 comprising a plurality of mail boxes 3, said boxes arranged in horizontal rows 5 and vertical columns 7 and retained in said assembly by an outer frame 9. Each said box is defined by a central storage container 13 bounded at the front by a lockable front door 15 and accessible to distribute mail therein. One means of accessibility is through the front end of the box when door 15 is temporarily removed and another means is through a separate access opening 17. Front doors 15 preferably lie in a common vertical plane x-y and face outward at heights above ground accessible from the windows of the driver's door of vehicles.

Figure 2:
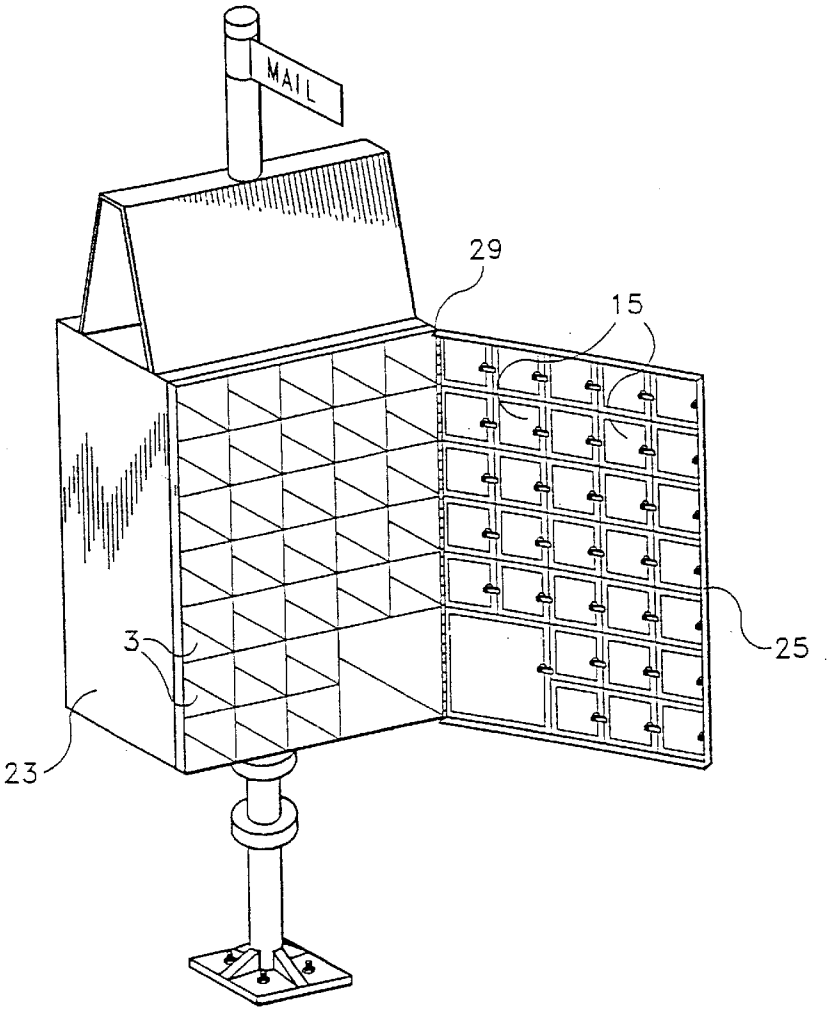
FIG. 2 is an illustrated view of the embodiment shown in FIG. 1 with the front panel pivoted open to show the interior and to show how the mail is distributed into the separate mail boxes by "front" loading.

Frame 9 is comprised of spaced-apart top and bottom panels 19 held apart by spaced-apart opposed side panels 23 and a front and rear panel 25 and 27 respectively. All said panels are joined together along their intersecting marginal edges. One or more panels are removable to permit access to central storage containers 13 to distribute the mail therein. As shown in FIG. 2, front panel 25 is pivotally mounted on hinges 29 to the vertical marginal edge of one of side panels 23 and openable by the postal worker or other employee in order to gain entry to mail boxes 3 to distribute the mail. In this embodiment, mail box doors 15 are hingedly connected to front panel 25 and move outward, away from boxes 3, when front panel 25 is pivoted outward on hinges 29. The postal or other employee can then distribute the mail in through the front of each mail box 3. This is known as "front" loading the mail boxes.

Figure 3:
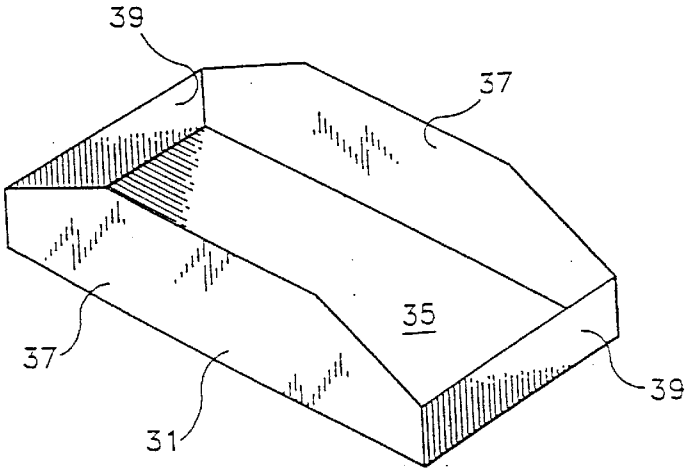
FIG. 3 is an illustrative view of a mail tray that is optionally placed in each mail box so that the box renter can tip it upward or remove it completely and hold it to see whether all the mail has been removed from the mail box.

A mail tray 31 is optionally provided in each mail box 3 that covers mail box floor 4 and is narrow enough to be extracted by the box renter through mail box front door 15. Tray 31 is provided so that those whose driver-side window and front seat do not allow them to be high or low enough to view the entire interior of said mail box can pull tray 31 partially or even fully out of box 3 in order to visually check to see that all of the contents of said box have been extracted. As shown in FIG. 3, mail tray 31 comprises a flat tray floor 35, bounded by upstanding tall side walls 37 that are held in spaced-apart relationship by a pair of spaced-apart shorter end walls 39. Front end wall 39 is short so that it can be easily grasped by the box renter's hand at the front of the box while both front and rear end walls 39 are short so that they will not interfere with front loading or rear loading of mail boxes 3.

Figure 5:
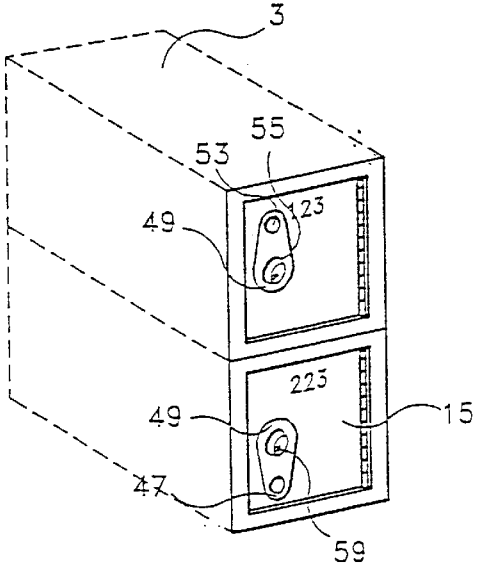
FIG. 5 is a close-up illustrative of two mail boxes in an assembly showing different positions of the small "flag" on the mail box.
Figure 4:
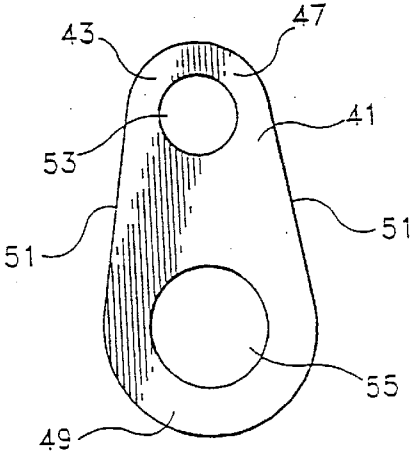
FIG. 4 is a front view of a small "flag" placed on the outside of the front door of the mail box that can be manipulated by the distributor of mail to indicate new mail has been loaded into a specific mail box.

Optionally, a mail flag 41 may be provided and located on the outside surface of mail box front door 15. Its purpose is to notify the mail box renter if mail has been distributed into his or her mail box since the last time he or she checked. FIGS. 4 and 5 show a typical design of mail flag 41 and show it to comprise a small tab 43 having a small, round top end 47 and a larger round bottom end 49 joined by straight sides 51. A first aperture 53 is formed in top end 47 for manipulation with the index finger in a circular manner, while a second aperture 55 is formed in bottom end 49 for connection to the outside surface of mail box door 15 such as in pivotal coupling with the lock barrel 59 located on front mail box door 15. In operation, the box renter inserts his or her index finger into first aperture 53 and rotates flag 41 downward to show that the box is empty of mail. When the postal or other employee distributes mail to boxes 3, he or she can insert their index finger in the same aperture 53 and rotate flag 41 upward to show that new mail has arrived in that box. Flag 41 may be held in pivotal relationship against the lock barrel 59 by a spring and clip as is known in the prior art. FIG. 5 shows the position of "no" mail for box number 223 while flag 41 is moved upward to show "new" mail in box 123.

As shown in FIGS. 6–9, a support 61, preferably in the form of a strong pipe 63 or one pipe in concentric relationship inside another pipe, is set in vertical arrangement at the middle or center of gravity of assembly 1 with its bottom end (not shown) sunk in a pillar of sand or concrete or the like in the ground to maintain the position of assembly 1 at a specific height and location and a portion of assembly 1 spaced above the ground over which the vehicles travel to and from said boxes.

Figure 6:
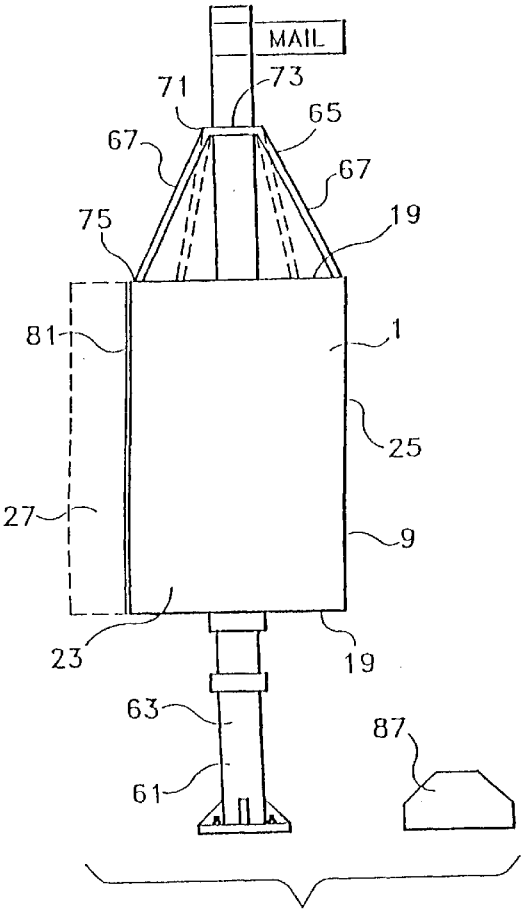
FIG. 6 is a side view of the embodiment shown in FIGS. 1 and 2 showing placement of a sign, opening at the rear of the assembly for distribution of mail (rear loading), placement of curbing about the perimeter of the assembly, and a typical support for maintaining the assembly spaced-above the ground.

A tent-like sign 65 may be erected above or on top of top panel 19 and comprises two flat or planar panels 67 joined along their respective top marginal edges 71 by cross-braces 73 (see FIG. 8) and their bottom marginal edges 75 resting on top panel 19 and are set outward from said top marginal edges such as either at the outer front and rear marginal edges of frame top panel 19, as shown in solid outline in FIG. 6, or inward a short distance therefrom, as shown in dotted outline in FIG. 6. Sign 65 performs two functions: first, it may carry advertisement or the mail address of assembly 1, and secondly, it takes up much of the room on top frame panel 19 to deter young people and other miscreants from climbing on top of frame 9 to perform misdeeds or injuring themselves.

Figure 7:
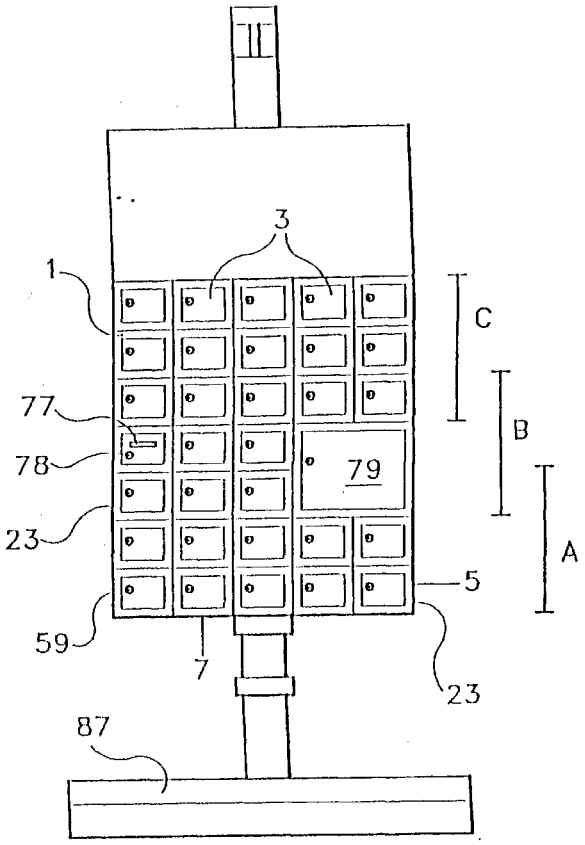
FIG. 7 is a front view of the embodiment shown in FIG. 6 showing the optional mail slot for outgoing mail, the optional large box for receipt of parcels larger than the rented mail box, and indicator lines showing the general rows of boxes rented to owners of sports car-type vehicles, sedan-type vehicles, and taller truck-type vehicles.

As shown in FIG. 7, in one of said boxes 3 optionally is formed a slot 77 for persons to drop letters for outgoing mail service. In this embodiment, the individual door lock 78 for this box acts as the master door lock for access by the postal or other employee, when removing outgoing mail therefrom, for unlocking front frame panel 25 to begin front loading mail into mail boxes 1.

In another location in assembly 1 is optionally located a large box 79 that is fitted with a lockable front door 15 and optionally a rear access opening 17 in which to place parcels that are too large to place in one of the other mail boxes. The mail distributor would leave a key to said large box 79 in the individual personal mail box 3 to which the parcel is directed to indicate to the box renter that a parcel is awaiting him or her in the large box.

Also as shown in FIG. 7, boxes 1 are arranged in horizontal rows 5 at different levels above the ground. Vertical lines A, B, and C are placed at the right side of FIG. 7 to indicate the desirable rows of boxes 3 to be rented to owners or operators of vehicles having different vertical heights of their driver's side window above the ground. For instance, vertical line A spans the rows that are amenable to renting to the driver of a low-slung sports-type vehicle, while vertical line B spans the rows that are amenable to renting to the driver of a sedan-type vehicle, and vertical line C spans the rows that are amenable to renting to the driver of a truck-type vehicle. It is to be presumed that these rows may be expanded or contracted as influenced by those who take advantage of this invention.

As shown in FIG. 6, distributing the mail to the mail boxes may be made at other points about frame 9. As shown, rear panel 27 may be hingedly connected to frame 9 at 81 and pivoted outward (shown in dotted outline) for distributing mail to said mail boxes. This is often called "rear" loading.

Figure 15:
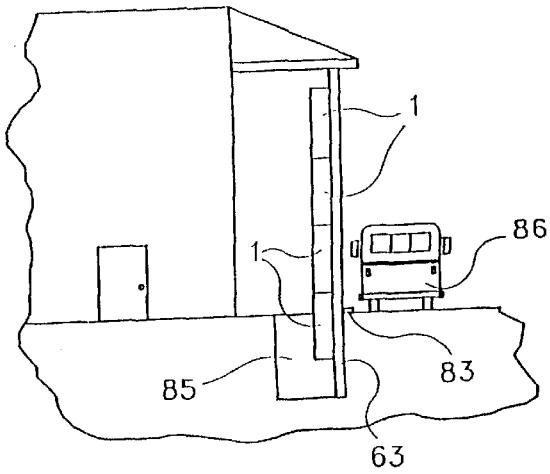

As shown in FIG. 15, for areas of maximum mail box renter density, it may be desirable to employ a system involving placing one assembly 1 on top of another assembly 1 and mount them in tiers on a pole 63 that is provided with a motor 83 to raise or lower the assemblies for access by the box renters. In this embodiment, it may be desirable to form a pit 85 in the ground where the bottom assembly could be lowered to allow access from a vehicle 86 to the mail boxes in the upper tier assembly.

As further shown in FIGS. 6–9, a plurality of parking curbs 87 are arranged about assembly 1 on the ground thereabout to prevent motor vehicles from colliding with assembly 1 or from coming so close to boxes 3 that the operation of opening of front mail box door 15 will cause it to bump against or scrape against the vehicle (see FIG. 8) or the mirrors and other appurtenances on the vehicle contact the assembly. The dotted outline of the outermost path of assembly 1 shows the need for curbs 87.

Figure 8:
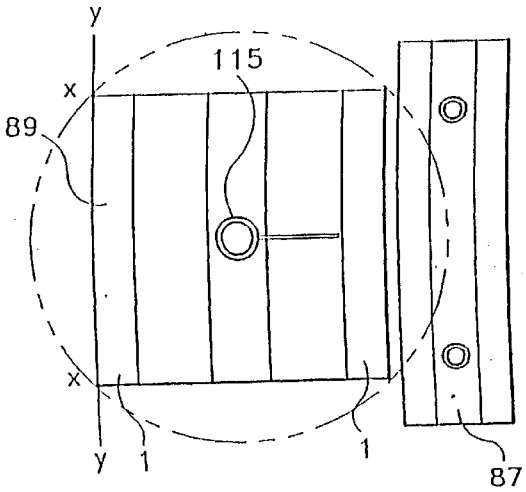
FIG. 8 is an illustrative view of a unit comprising two assemblies of boxes, the mechanical means for allowing the unit to be rotated through an arc and gravitational means for insuring it stops at a position where the mail box doors are in a plane that is parallel to the path of travel of the vehicles.
Figure 9:
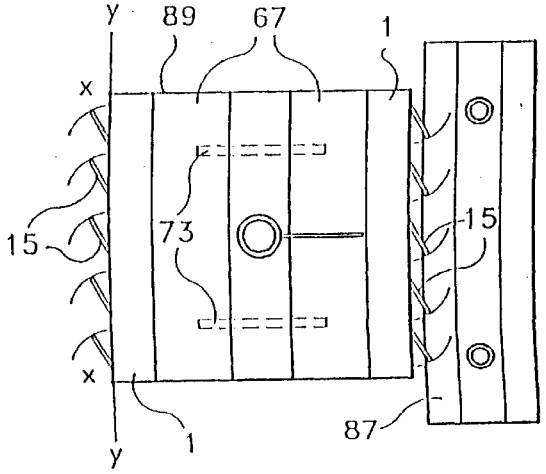
FIG. 9 is a top view of the unit shown in FIG. 8, showing placement of the curb about the outside of the unit in order to prevent the doors of the mail boxes from striking or scraping against the vehicle and the mirrors and other appurtenances on the vehicle from striking the unit.

In another embodiment of this invention, as shown in FIGS. 8 and 9, unit 89 is formed, comprised of two assemblies 1 of mail boxes 3 where front doors 15 of each assembly lie in separate vertical planes x-y that are spaced-apart and parallel to each other and wherein said front mail box doors 15 face mutually outward in opposite directions from each other. In this embodiment, access to unit 89 may be gained by driving up to each assembly and accessing the appropriate front door 15 from the vehicle driver's side window.

Figure 10:
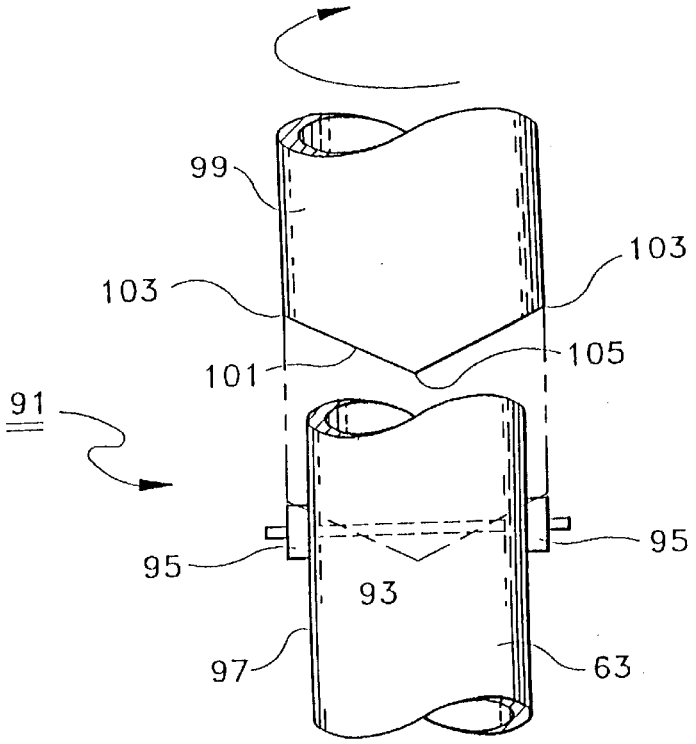
FIG. 10 is an illustrative view of mechanical means allowing the unit to be turned and always ending up with one of the planes of the mail box doors parallel to the path of vehicle travel.

In another embodiment of this invention, shown in FIG. 10, access to unit 89 may be obtained from either side by providing a means 91 in or adjacent support 61 to allow unit 89 to rotate through 180°. The mechanism for means 91 is shown in FIG. 10 and shows strong pipe 63, extending from the ground upward toward frame 9, and having a cross-axle 93 passing transversely therethrough on which a pair of cam wheels 95 are pivotally attached adjacent the outside surface 97 of said pipe.

A saddle 99 is concentrically mounted outside pipe surface 97 and above cross-axle 93 and is connected at its upper end to frame 9 and terminated at the bottom thereof by a tooth-shaped edge 101 that provides two upper notches 103, in diametrically opposed position, and two lower teeth 105, in diametrically opposed position and clocked 90° from notches 103. In operation, the weight of assembly 1 is sufficient to force upper notches 103 down over cam wheels 95 so that front panel 25, containing mail box front doors 15, is parallel to the path of vehicle travel past mail boxes 3.

When rotating assembly 1 about pipe 63, as shown by the arrow above saddle 99, lower teeth 105 are forced to ride on edge 101 and the whole assembly raises upward a small distance as teeth 105 approach the top of cam wheels 95. When teeth 105 reach their highest point, i.e., on top of cam wheels 95, assembly 1 will be 90° to the path of vehicle travel and the slightest push against assembly 1 will cause the weight of assembly 1 to turn itself another 90° so that the rear of assembly 1 is now adjacent and parallel to the path of vehicle travel. Assembly 1 can be continually turned by this mechanism and will always wind up having a front panel (or rear panel) parallel to the path of vehicle travel past mail boxes 3.

When two assemblies are grouped into a single unit 89, then any turning of unit 89 will present mail boxes of one of the planes x-y adjacent to and parallel with the path of vehicle travel past the mail box doors. It is important to place parking curbs 87 at a safe distance from unit 89 so that the rotation of either assembly 1 or unit 89 (shown in dotted outline in FIG. 9) does not bring any of the hardware from the assemblies or hardware from the vehicles into contact with each other.

Figure 11:
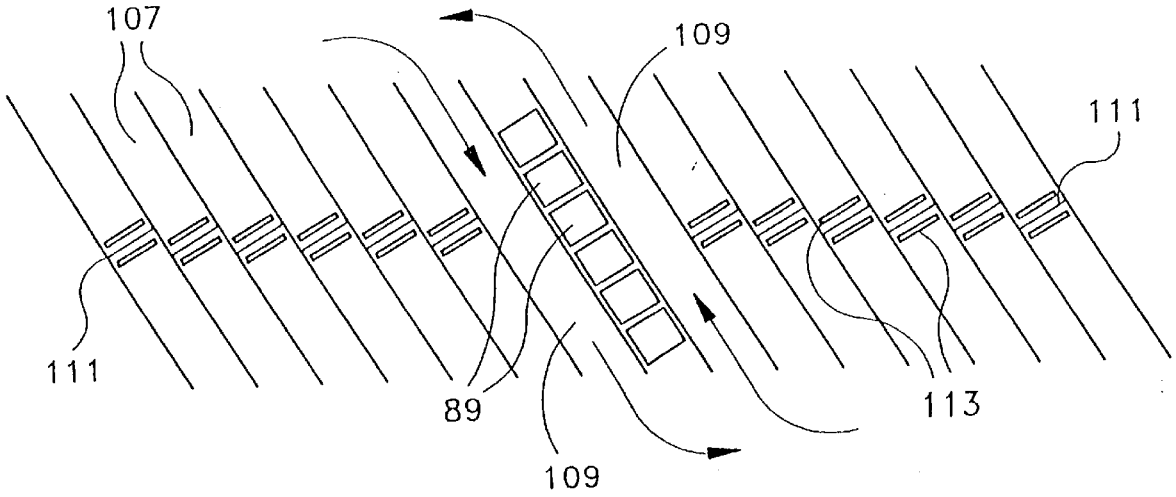
FIG. 11 is an illustrative view of an existing parking lot showing how this invention can be placed therein and using only six nose-to-nose parking slots while drawing far more potential shoppers to the area.

FIG. 11 shows how units 89 of this invention may be placed in a single line in a nose-to-nose parking space 107 and use that space with single lanes 109 on each side thereof to support up to 360 (60 boxes/unit×6 units) rental mail boxes. Each nose-to-nose parking space is divided by a parking separator line 111 and parking curbs 113. The use of the two parking spaces in space 107 and two more spaces for each of the two lanes 111 means that a total of 6 parking spaces are given up to bring in up to 360 potential buyers of goods in the mall to the parking lot.

An optional flag pole 115 is shown in FIG. 1 mounted on top frame panel 19 and extends upward to a height substantially above frame 9. A flag 119 may be attached to pole 115 and raised or lowered by the postal or other employee to indicate that mail has arrived at assembly 1 or unit 89.

Figure 12:
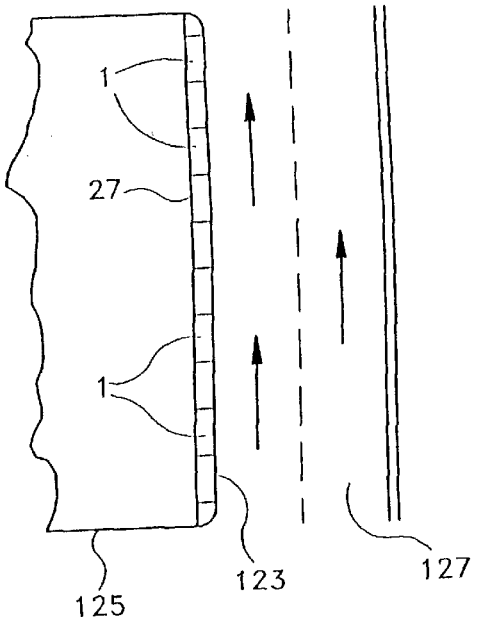
FIG. 12 is an illustrative view of how this invention can be used at a newly constructed postal distribution point to facilitate many more patrons without having to increase the size of the existing parking lot.

FIG. 12 shows a system involving a plurality of assemblies 1 set in side-by-side fashion on the wall 123 of an existing building 125 as a dual vehicle lane 127 established adjacent wall 123 so that box renters can stop and pick up their mail without leaving their vehicle. This construction would serve well in situations where postal building wish to expand their services and cannot or do not wish to increase the size of their parking lot. Assemblies 1 are conveniently rear loaded, i.e., rear panel 27 is opened and the mail is distributed through access opening 17 from the rear of assembly 1.

Figure 13:
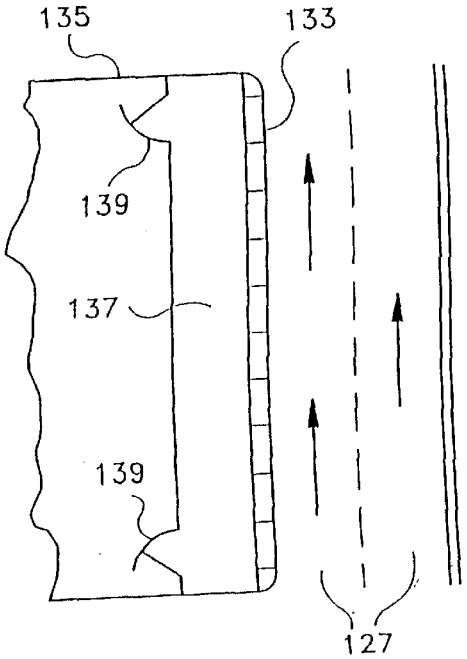
FIG. 13 is an illustrative view of how this invention can be retrofitted into an existing building.

FIG. 13 shows a system involving new construction of a wall 133 can be made outward from an existing building 135 and made accessible by a walkway 137 that is reachable by doorways 139 at each end thereof. A plurality of assemblies 1 are set adjacent wall 133 for access by box renters driving vehicles along lane 127 adjacent wall 133. This construction would serve well in situations where a postal building can be modified to increase access to rented mail boxes. Assemblies 1 are conveniently rear loaded, and rear panel 27 is opened and the mail is distributed through access opening 17 from the rear of assembly 1.

Figure 14:
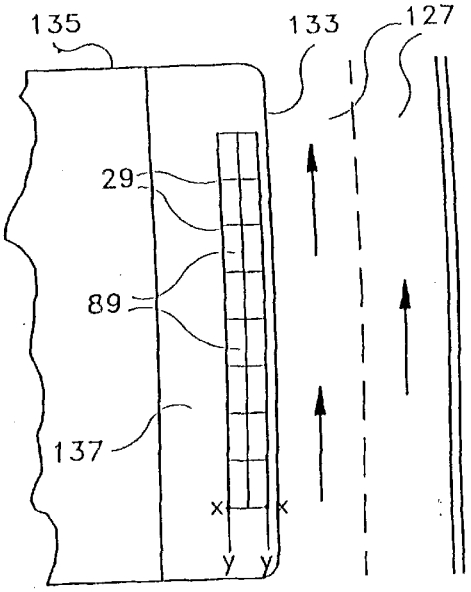
FIG. 14 is an illustrative view of a single unit with a rotating assembly; and, FIG. 15 is an illustrative view of a group of tiered assemblies and how they can be raised and lowered to facilitate usage by box renters.

FIG. 14 shows a system for coping with higher density operation where units 89 are placed in side-by-side arrangement along the inner edge of a wall 133 that are turnable about their support 61 as previously described. A pair of lanes 127 are provided adjacent units 89 so that the driver can access his or her rental mail box by pulling up to the particular row and unlocking the door. Units 89 are front loaded by pivoting front panel 25 outward on hinge 29 to gain access to boxes 3 that are exposed at one plane x-y of the unit facing away from lane 127.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the way to achieve substantially the same result are within the scope of this invention.

What is claimed is:

1. A drive-up mail distribution, storage and pick-up assembly comprising:

a) a plurality of mail boxes, said boxes arranged in horizontal rows and retained in a frame including a front panel, each said box able to be accessed for loading with mail and including a lockable front door on said boxes opening from said front panel; and, b) a driveway including a surface over which a motor vehicle may pass, said motor vehicle of the type having a driver operating said vehicle from a seat located therein, said driveway arranged in such close proximity to said front panel of said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

2. The assembly of claim 1 wherein said mail boxes further include an access opening, separate from said front door, in which to load mail therein.

3. The assembly of claim 1 wherein said front doors of said boxes lie in a common vertical plane.

4. The assembly of claim 1 wherein said rows of said mail boxes are set at heights accessible from the windows of the driver's door of a low slung sport-type vehicle.

5. The assembly of claim 1 wherein said rows of said mail boxes are set at heights accessible from the windows of the driver's door of a medium-height sedan-type vehicle.

6. The assembly of claim 1 wherein said rows of said mail boxes are set at heights accessible from the windows of the driver's door of a tall truck-type vehicle.

7. The assembly of claim 1 wherein each said mail box includes a floor and further includes a mail tray in each said mail box that covers at least a portion of the floor thereof and is narrow enough to be extracted through said mail box front door opening so that those whose driver-side window and front seat do not allow them to be high or low enough to view the entire interior of said mail box can pull said tray out of said box in order to visually check to see that all of the contents of said tray has been extracted.

8. The assembly of claim 7 wherein said mail tray comprises a flat tray floor bounded by upstanding tall side walls that are held in spaced-apart relationship by a pair of spaced-apart shorter end walls, said end walls being short so that said tray can be easily grasped by the box renter's hand at the front of said mail box while both said front and rear end walls are short so that they will not interfere with front loading or rear loading of said mail box.

9. The assembly of claim 1 further including a mail flag attached to said mail box door for indicating to the box renter whether new mail has been distributed into said mail box.

10. The assembly of claim 9 wherein said mail flag comprises:

a) a small tab having a small, round top end, a larger round bottom end, said top end and said bottom end joined together by sides extending therebetween;

b) a first aperture formed in said top end for manipulation with the index finger in a circular manner; and, c) a second aperture formed in said bottom end for pivotal connection to the outside surface of said mail box door so that both the distributor of mail can rotate said flag into one position indicating new mail has been placed in said mail box, while the box renter can rotate said flag into another position indicating the mail has been removed from said mail box.

11. The assembly of claim 1 further including a support for said frame to maintain at least a portion of said boxes spaced above said driveway surface over which said vehicle travels to and from said mail boxes.

12. The assembly of claim 1 further including a sign erected on top of said frame.

13. The assembly of claim 1 further including a slot formed in one of said boxes and opening into said front panel for persons to drop letters for outgoing mail service while sitting in their vehicle.

14. The assembly of claim 11 wherein said support includes motorized means for raising and lowering said assembly to allow access to said boxes from vehicles of different heights above said driveway surface.

15. The assembly of claim 11 further including gravity-operated cam means for allowing said assembly to be turned and always stop at a position where said lockable mail box doors are in a plane parallel to the pathway of the vehicle that is brought into close proximity on said driveway surface.

16. The assembly of claim 15 wherein said gravity-operated cam means comprises:

a) a support for said frame to maintain at least a portion of said boxes spaced above the ground adjacent to said driveway over which the vehicles travel to and from said mail boxes:

b) a cross-axle passing transversely through said support on which a pair of cam wheels are pivotally attached adjacent the outside surface thereof; and, c) a saddle of terminal length concentrically mounted outside said pipe surface in close proximity thereto and above said cross-axle and connected at its upper terminal end to said frame and having a tooth-shaped edge along its lower terminal end;

d) said tooth-shaped edge comprising a pair of upper notches, in diametrically opposed position with each other and a pair of lower teeth, in diametrically opposed position and clocked 90° from said notches;

e) wherein the weight of said assembly is sufficient to force said upper notches down over said cam wheels so that said front panel, containing said mail box front doors, is parallel to the path of vehicle travel past said mail boxes and, when rotating said assembly about said support, said lower teeth are forced to ride on said edge and said assembly raises upward a short distance as said teeth approach the top of said cam wheels and when said teeth reach their highest point, said assembly will be 90° to the path of vehicle travel and the slightest push against said assembly will cause the weight of said assembly to turn itself another 90° so that the rear of said assembly becomes adjacent and parallel to a vehicle on said driveway.

17. The assembly of claim 1 further including parking curbs placed on the ground about said assembly to prevent vehicles from contacting said mail boxes.

18. A drive-up mail distribution, storage and pick-up system comprising:

a) two assemblies of mail boxes, each assembly comprising a plurality of mail boxes, said boxes arranged in horizontal rows and retained in said assembly in a frame including a front panel, each said box able to be accessed for loading with mail and including a lockable front door, wherein said front doors of each said assembly lie in separate vertical planes that are spaced-apart and parallel to each other and wherein said front mail box doors of each assembly face mutually outward in opposite directions from each other;

b) a driveway including a surface over which a motor vehicle may pass, said motor vehicle of the type having a driver operating said vehicle from a seat located therein, said driveway arranged in such close proximity to said front panel of each said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

19. A drive-up mail distribution, storage and pick-up system comprising:

a) a plurality of units mounted in an existing outside wall of a building, each unit comprising two assemblies of mail boxes, each assembly comprising a plurality of mail boxes, said boxes arranged in horizontal rows and retained in said assembly in a frame including a front panel, each said box able to be accessed for loading with mail and including a lockable front door, where said front doors of each said assembly lie in separate vertical planes that are spaced-apart and parallel to each other and wherein said front mail box doors of each said assembly face mutually outward from said wall in opposite directions from each other;

b) a driveway including a surface over which a motor vehicle may pass, said motor vehicle of the type having a driver operating said vehicle from a seat located therein, said driveway arranged in such close proximity to said front panel of said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

20. A drive-up mail distribution, storage and pick-up system comprising:

a) a plurality of units, mounted in a new wall outside of a building, each unit comprising two assemblies of mail boxes, said boxes arranged in horizontal rows and retained in said assembly in a frame including a front panel, each said box able to be accessed for loading with mail and including a lockable front door, where said front doors of each said assembly lie in separate vertical planes that are spaced-apart and parallel to each other and wherein said front mail box doors of each assembly face mutually outward from said wall in opposite directions from each other;

b) a driveway including a surface over which a motor vehicle may pass, said motor vehicle of the type having a driver operating said vehicle from a seat located therein, said driveway arranged in such close proximity to said front panel of said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

21. A drive-up mail distribution, storage and pick-up system comprising:

a) a plurality of units, each unit comprising two assemblies of mail boxes, each assembly mounted in a new outside wall of a building, each comprising a plurality of mail boxes, said boxes arranged in horizontal rows and retained in said assembly in a frame including a front panel, each said box able to be accessed for loading with mail and including a lockable front door, where said front doors of each said assembly lie in separate vertical planes that are spaced-apart and parallel to each other and wherein said front mail box doors of each assembly face mutually outward in opposite directions from each other;

b) a driveway including a surface over which a motor vehicle may pass, said motor vehicle of the type having a driver operating said vehicle from a seat located therein, said driveway arranged in such close proximity to said front panel of said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

22. A drive-up mail distribution, storage and pick-up system comprising:

a) a plurality of units, each unit comprising two assemblies of mail boxes mounted along a new wall constructed apart from a building, each assembly comprising a plurality of mail boxes, said boxes arranged in horizontal rows and retained in a frame including a front panel, each said box able to be accessed for loading with mail and including a lockable front door, where said front doors of each said assembly lie in separate vertical planes that are spaced-apart and parallel to each other and wherein said front mail box doors of each assembly face mutually outward in opposite directions from each other;

b) a driveway including a surface over which a motor vehicle may pass, said motor vehicle of the type having a driver operating said vehicle from a seat located therein, said driveway arranged in such close proximity to said front panel of said assembly that the driver of said vehicle can reach out from said vehicle and open and close said mail box front door without having to leave the vehicle;

c) wherein the vertical distance between said driveway surface and said horizontal rows of said mail boxes is in a range of measurement at various heights above said driveway surface substantially commensurate with various heights at which the driver or passenger can reach from different types of vehicles to a particular row of said mail boxes.

* * * * *